United States Patent [19]

Yaneza

[11] Patent Number: 4,957,125

[45] Date of Patent: Sep. 18, 1990

[54] TOOTHBRUSHING ASSEMBLY

[76] Inventor: Merle L. Yaneza, 11708 S. Valley View, Whittier, Calif. 90604

[21] Appl. No.: 385,439

[22] Filed: Jul. 26, 1989

[51] Int. Cl.[5] ..... G01F 11/00; A46B 11/00

[52] U.S. Cl. ..... 132/309; 222/390; 401/175; 401/123; 401/195; 132/309

[58] Field of Search ..... 132/308, 309, 311; 401/175, 123, 195; 222/390

[56] References Cited

U.S. PATENT DOCUMENTS

| | | | |
|---|---|---|---|
| 965,309 | 7/1910 | McDonald | 132/311 |
| 1,236,878 | 8/1917 | Salvas | 401/175 |
| 1,336,390 | 4/1920 | Sargery | 401/175 |
| 1,711,183 | 4/1929 | Smith | 132/311 |
| 2,699,889 | 1/1955 | Johnson | 222/390 |
| 4,122,983 | 10/1978 | Jolly | 222/390 |

*Primary Examiner*—Richard J. Johnson

*Attorney, Agent, or Firm*—Edgar W. Averill, Jr.

[57] ABSTRACT

A tooth brushing assembly for dispensing both toothpaste and dental floss. The assembly includes a toothpaste reservoir which has a cylindrical knob at the rear thereof. A spool of dental floss is held within the chamber, and the knob has a cap and cutoff blade associated with it. Preferably, a tooth brush is affixed over the cap end of the reservoir, and a preferred method of dispensing the toothpaste with a piston is also disclosed.

1 Claim, 1 Drawing Sheet

TOOTHBRUSHING ASSEMBLY

BACKGROUND OF THE DISCLOSURE

The field of the invention is dental care apparatus, and the invention relates more particularly to means for dispensing toothpaste and dental floss.

It is widely known that the use of dental floss is a very important adjunct to proper tooth care. Although, most people brush their teeth regularly, a far fewer number regularly use dental floss.

SUMMARY OF THE INVENTION

It is an object of the present invention to provide a toothbrushing assembly which includes a dispenser for dental floss.

The present invention is for a toothbrushing assembly for dispensing both toothpaste and dental floss. The assembly has a toothpaste reservoir with a cap end and an external end. A cylindrical knob is affixed to the reservoir at the external end thereof, and the cylindrical knob has an outwardly facing cylindrical chamber. A spool of dental floss is held within the outwardly facing cylindrical chamber and is held therein by a cap and cutoff member which is affixed thereto. Preferably, a toothbrush is affixed over the cap end of the reservoir so that as the toothbrush is being used, the dental floss is directly at hand. Preferably, the toothpaste reservoir has a cylindrical inner wall and a threaded shaft is affixed to the cylindrical knob which holds the dental floss. A piston with an internal thread is held within the reservoir, and the toothpaste is extruded from the cap end of the reservoir by turning the knob, thus advancing the piston.

DESCRIPTION OF THE PREFERRED EMBODIMENTS

Figures 1, 2, 3, 4:
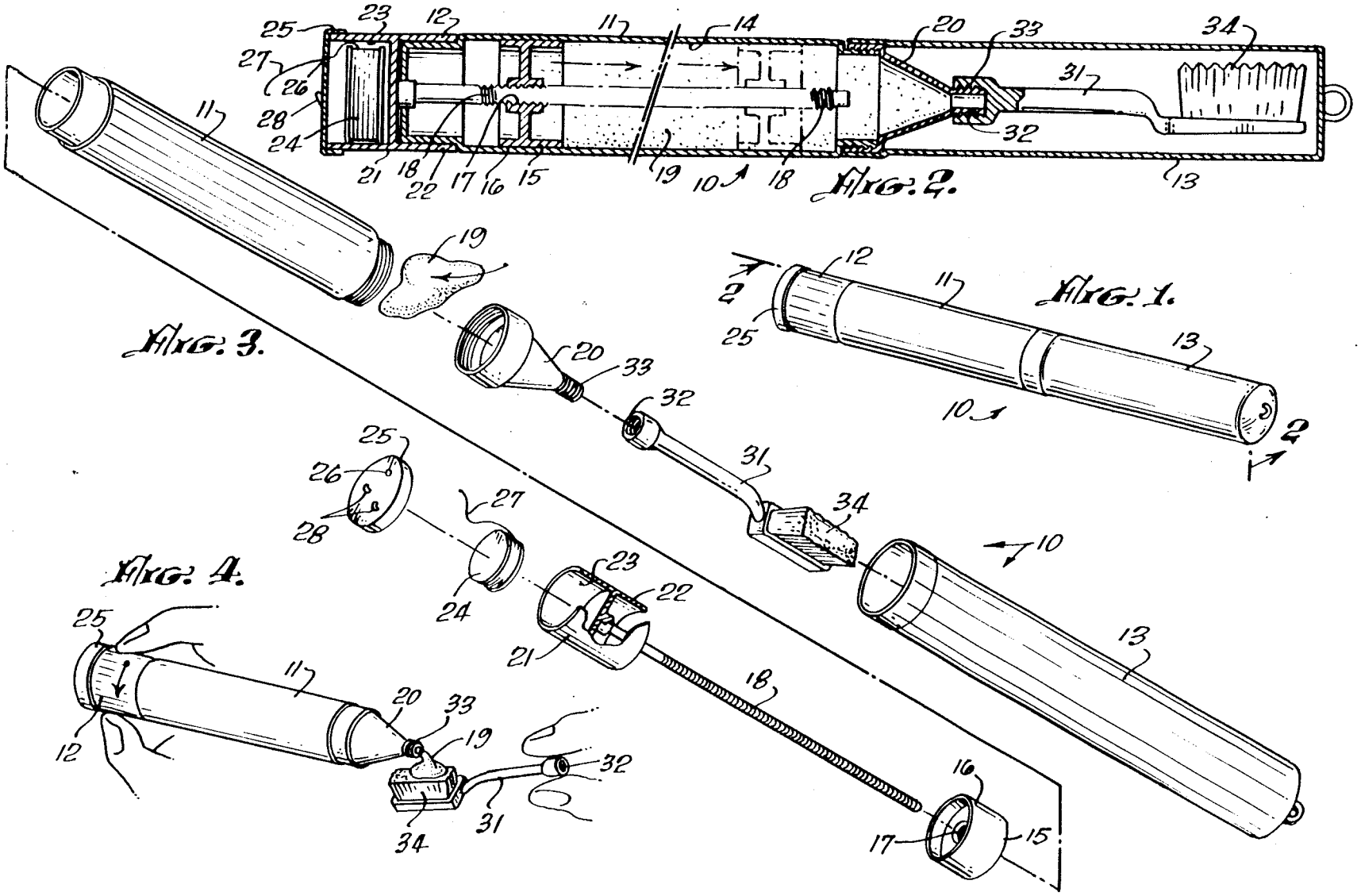
FIG. 1 is a perspective view of the toothbrushing assembly of the present invention.
FIG. 2 is an enlarged cross-sectional view taken along line 2—2 of FIG. 1.
FIG. 3 is an exploded perspective view of the toothbrushing assembly of FIG. 1.
FIG. 4 is a perspective view showing the toothbrushing assembly reservoir being used to extrude toothpaste onto a toothbrush.

The toothbrushing assembly of the present invention is shown in perspective view in FIG. 1 and identified by reference character 10. Assembly 10 has a cylindrical toothpaste reservoir 11, a cylindrical knob 12 which is used to extrude toothpaste as described more fully below and a toothbrush cover 13.

The construction of assembly 10 is shown in cross-sectional view in FIG. 2 where it can be seen that reservoir 11 has an inner reservoir wall 14 which holds a piston 15 which has an outer contact wall 16 which abuts the inner wall 14. Piston 15 has internal threads 17 which mate with a threaded shaft 18 which is axially positioned with reservoir 11. Toothpaste 19 fills that portion of reservoir 11 between piston 15 and the conical cover 20. Threaded shaft 18 is affixed to a cylindrical knob 21 which has an inwardly directed skirt 22 and an outwardly facing cylindrical chamber 23. A spool of dental floss 24 is loosely held within chamber 23, and a cap and cutoff means 25 is secured over the opening of chamber 23. Cap 25 has an opening 26 through which floss 27 may be withdrawn. A cutoff blade 28 is affixed to cap 25 to facilitate the cutting off of a length of floss.

In use, the toothbrush 31 has a threaded opening 32 and may be unscrewed from the threaded end 33 of cover 20. Toothpaste is then extruded onto the bristles 34, as shown in FIG. 4, by turning knob 21 to advance piston 15 within reservoir 11. Toothbrush 31 is then again attached onto cover 20, and the unit makes an easily held toothbrush. The dental floss 27 is readily available, and its use is greatly facilitated by its presence at the end of the toothbrushing assembly. For travel, the cover 13 is easily snapped in place, and its unitary construction facilitates packing.

Preferably, the unit is injection molded from a polymer such as polyvinylchloride. When the toothpaste has been used up, the reservoir can be refilled if desired.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

What is claimed is:

1. A tooth brushing assembly for dispensing both toothpaste and for dispensing dental floss, said assembly comprising:

a cylindrical toothpaste reservoir having a cap end and an external end and an inner reservoir wall, said cap end including a conical cover to which a toothbrush is removably affixed and wherein said toothbrush includes a cover which is impervious to toothpaste;

a cylindrical knob affixed to said reservoir at the external end thereof, said cylindrical knob having an outwardly facing cylindrical chamber and having an inwardly facing cylindrical chamber and having an inwardly facing cylindrical chamber which surrounds the external end of said reservoir to support the cylindrical knob;

a threaded shaft affixed to said cylindrical knob and extending axially within said cylindrical toothpaste reservoir to about the cap end thereof;

a piston having an outer contact wall and having internal threads which mate with the threads of said threaded shaft, said piston being positioned within said cylindrical reservoir, and the outer contact wall touching the inner reservoir wall;

a spool of dental floss held within said outwardly facing cylindrical chamber; and cap and cutoff means affixed to said outwardly facing cylindrical chamber.

* * * * *